US008327913B2

(12) United States Patent
Iwasaki et al.

(10) Patent No.: US 8,327,913 B2
(45) Date of Patent: Dec. 11, 2012

(54) CASTING METHOD TO PRODUCE A CASTING AND PRESS USED FOR THE CASTING METHOD

(75) Inventors: Junichi Iwasaki, Toyokawa (JP); Yutaka Hagata, Toyokawa (JP)

(73) Assignee: Sintokogio, Ltd., Aichi (JP)

( * ) Notice: Subject to any disclaimer, the term of this patent is extended or adjusted under 35 U.S.C. 154(b) by 3 days.

(21) Appl. No.: 12/311,891

(22) PCT Filed: Jun. 29, 2007

(86) PCT No.: PCT/JP2007/063509

§ 371 (c)(1),
(2), (4) Date: Apr. 17, 2009

(87) PCT Pub. No.: WO2008/047503

PCT Pub. Date: Apr. 24, 2008

(65) Prior Publication Data

US 2010/0307707 A1 Dec. 9, 2010

(30) Foreign Application Priority Data

Oct. 20, 2006 (JP) ..... 2006-286041
Nov. 28, 2006 (JP) ..... 2006-319712
Mar. 19, 2007 (JP) ..... 2007-070275

(51) Int. Cl.
*B22D 46/00* (2006.01)
*B22D 17/32* (2006.01)

(52) U.S. Cl. ..... 164/154.1; 164/154.2; 164/4.1; 164/137

(58) Field of Classification Search ..... 164/4.1, 164/154.1, 154.2, 154.3, 154.4, 136, 137
See application file for complete search history.

(56) References Cited

U.S. PATENT DOCUMENTS 4,049,040 A 9/1977 Lynch
5,269,364 A * 12/1993 Murata ..... 164/309
5,288,440 A * 2/1994 Katagiri et al. ..... 264/40.5
(Continued)

FOREIGN PATENT DOCUMENTS

JP 08-010890 1/1996
(Continued)

OTHER PUBLICATIONS

Illustrated Foundry Dictionary, 1st Ed., published by Nikkan Kogyo Sinbunsha, Japan, Nov. 30, 1995, p. 212.

*Primary Examiner* — Devang R Patel
(74) *Attorney, Agent, or Firm* — Finnegan, Henderson, Farabow, Garrett & Dunner, L.L.P.

(57) ABSTRACT

A casting method to produce a casting and a press used for the casting method, using a mold which forms a cavity in a shape of a casting, so as to produce a casting by overlapping a lower mold with an upper mold, which molds are molded by a molding method, the casting method comprises the steps of:

pouring into the lower mold a quantity of molten metal required to produce a casting;

lowering the upper mold at a predetermined first speed until the upper mold reaches a predetermined position just before the upper mold starts contacting a surface of the molten metal;

lowering the upper mold at a predetermined second speed after the upper mold is further lowered beyond the predetermined position;

detecting and obtaining information on the status of the upper mold which overlaps the lower mold; and stopping the lowering of the upper mold when detecting the information on the status of the upper mold that shows that the predetermined conditions are met.

4 Claims, 13 Drawing Sheets

U.S. PATENT DOCUMENTS

| | | | | |
|---|---|---|---|---|
| 5,595,236 | A * | 1/1997 | Lee et al. | 164/319 |
| 5,908,065 | A * | 6/1999 | Chadwick | 164/120 |
| 6,957,687 | B2 * | 10/2005 | Hirata et al. | 164/154.2 |

FOREIGN PATENT DOCUMENTS

| | | |
|---|---|---|
| JP | 2005-034851 | 2/2005 |
| JP | 2005-52871 | 3/2005 |
| JP | 2005-074461 | 3/2005 |
| SU | 725 805 A1 | 4/1980 |
| WO | WO 92/05900 | 4/1992 |
| WO | WO 2006/093469 A1 | 9/2006 |

* cited by examiner

CASTING METHOD TO PRODUCE A CASTING AND PRESS USED FOR THE CASTING METHOD

TECHNICAL FIELD

This invention relates to a casting method to produce a casting and a press for the casting method. More specifically, it relates to the casting method to produce a casting and the press for the casting method that produce a casting by overlapping an upper mold over a lower mold, into which lower mold a required quantity of molten metal is poured.

BACKGROUND ART

Conventionally it is considered indispensable in manufacturing a casting that, to obtain a good casting by pouring molten metal into a cavity of a mold that is formed when the upper mold and the lower mold are overlapped, by controlling the flow of molten metal and by limiting any impure substance and gas in the product, a passage for the molten metal called a gating system, which has nothing to do with the shape of a casting (see, for example, Non-Patent Publication 1), be provided. However, the gating system often has lowered the yield rate of castings. Moreover, it also requires removing the gating system after crushing the mold. Thus the gating system often worked disadvantageously to the productivity and the cost efficiency of casting.

Therefore, to improve the yield rate for casting, it is proposed to use a casting method wherein it is carried out by using a lower mold, which is a mold formed by various kinds of molding methods, and which has no gating system, but only a cavity required for casting, and an upper mold, which is a mold formed by various kinds of molding methods, and has no cavity for a gating system, but which has a convex portion capable of forming a cavity for casting. In this casting method it is proposed that, after the molten metal required to produce only the casting is poured into the cavity of the lower mold, the convex portion of the upper mold be advanced into the cavity filled with the molten metal so as to form the cavity required to produce the casting, and that then the upper mold overlap the lower mold (a sand-mold press-casting process) (see Patent Publication 1).

This casting method can easily produce a desired casting without fail while keeping a high yield rate of molten metal.

[Non-Patent Publication 1]

Nihon Chuzou Kogakukai (Japan Foundry Engineering Society), Illustrated Foundry Dictionary, 1st Ed., published by Nikkan Kogyo Sinbunsha, Japan, Nov. 30, 1995, page 212, gating system, and

[Patent Publication 1] Patent Application Publication No. JP2005-52871

DESCRIPTION OF THE INVENTION

However, the casting method described above forms a shape of a casting by causing the upper mold to overlap the lower mold after the molten metal is poured into the lower mold, such that to produce a casting of good quality, a mass-production process of casting, which is different from the conventional gating system, is desired to be established, with its various conditions for production being clearly defined in terms of, for example, the weight of a casting, its shape, the quantity of the molten metal to be poured, the speed of the press, the press load, and the like.

To meet these requirements, this invention aims to provide a casting method and a press for the casting method that produce a casting of a high quality by controlling the speed of the press in the pressing process when the upper mold is made to overlap the lower mold.

The casting method to produce a casting, of the present invention is a method to produce a casting, using a mold which forms a cavity in a shape of a casting, so as to produce a casting by overlapping a lower mold with an upper mold, which molds are molded by a molding method, said casting method comprising steps of pouring into the lower mold a quantity of molten metal required to produce a casting;

lowering the upper mold at a predetermined first speed until the upper mold reaches a predetermined position just before the upper mold starts contacting a surface of the molten metal;

lowering the upper mold at a predetermined second speed after the upper mold is further lowered beyond the predetermined position;

detecting and obtaining information on the status of the upper mold which overlaps the lower mold; and, stopping the lowering of the upper mold when detecting the information on the status of the upper mold that shows that the predetermined conditions are met.

The press for the casting method, of the present invention is a press for the casting method to produce a casting, comprising:

a movable frame;

a up-and-down means supported by the movable frame;

a plate that presses the mold, which plate is connected to the end portion of a rod of the up-and-down means;

guide rods installed perpendicularly the plate that presses the mold;

a fixing means attached to the plate that presses the mold, to fix the upper mold, a detection means to detect and obtain information on the status of the upper mold, which mold is caused to overlap the lower mold by means of the up-and-down means; and a control means to control the movable frame, the up-and-down means, and the fixing means wherein the control means also controls the movement of the up-and-down means based on the information as detected and obtained by the detection means, wherein the speed at which the up-and-down means is lowered as a movement of 1, the up-and-down means comprises setting a speed at the predetermined first speed until the upper mold is lowered to the predetermined position just before the upper mold starts contacting the surface of the molten metal, and setting a speed at the predetermined second speed after the upper mold is further lowered beyond the predetermined position.

According to the present invention, the press is controlled in such a way that the lowering speed of the upper mold is changed from the first speed to the second speed, and the press completes the pressing by stopping the lowering of the upper mold when the information on the status of the upper mold shows that the predetermined conditions are met, so that it is possible to minimize the time from a pouring of molten metal to the completion of the pressing, thereby enabling the metal structure to be made uniform by making the temperature distribution of the molten metal in a cavity uniform. Further, by detecting the pressure of the pressing process, an excessive pressing of the upper mold onto the lower mold can be avoided, and a casting of good quality in terms of accuracy of dimensions can always be obtained.

BEST MODE FOR CARRYING OUT THE INVENTION

The casting method of the present invention can use a lower mold comprising a concave portion constituting, for example, a part of the shape of a casting, into which portion the quantity of molten metal required to produce a casting is poured; and an upper mold comprising a convex portion constituting, for example, a part of the shape of a casting and forming a cavity required to produce a casting, when the upper mold overlaps the lower mold.

The lower mold and the upper mold can be suitably molded by various molding methods, such as a green sand mold, shell mold, cold box molding process, self-hardening mold, and the like. The mold according to the present invention may comprise a core in either the upper mold or the lower mold. The mold according to the present invention may also comprise a porous permanent mold. The molding methods according to the present invention are not limited to squeeze molding, blow squeeze molding, air flow and press molding, or a mixture thereof, but comprise molding methods like molding by machinetool, pour molding, and the like. The castings are products having a gating system, such as sprue, runner, ingate, and the like, and a gating system such as riser, flow-off gas vent, or the like, removed from the molded materials that are taken out from the mold after the molding flask is shaken out, such that they can be fitted to or installed in the machine as a final part or component, or can be commercially sold as independent products, such as a round-shaped brake drum or a square case. The molten metals described above are those ferrous or non-ferrous metals in a melted state that can be poured into the mold.

Figure 1:
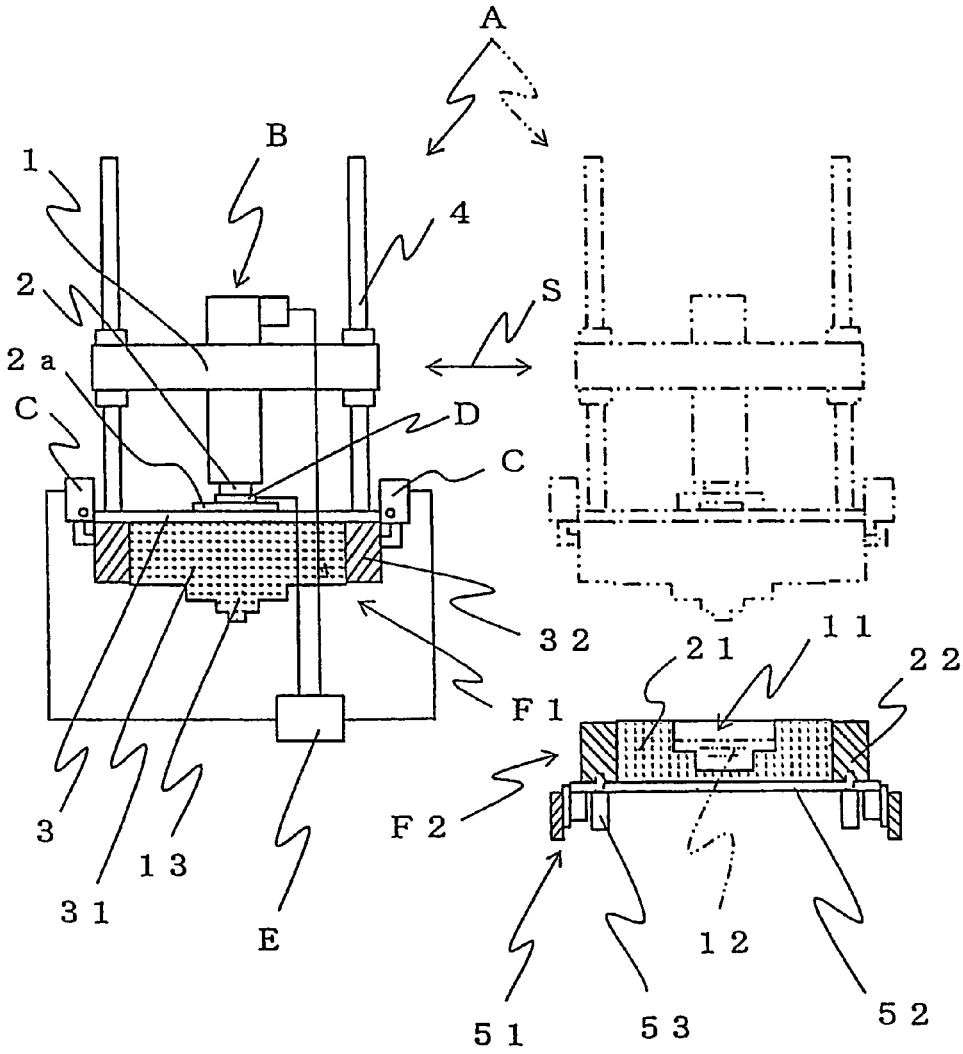
FIG. 1 shows a schematic view of the press for casting in one embodiment of the present invention.
Figure 6:
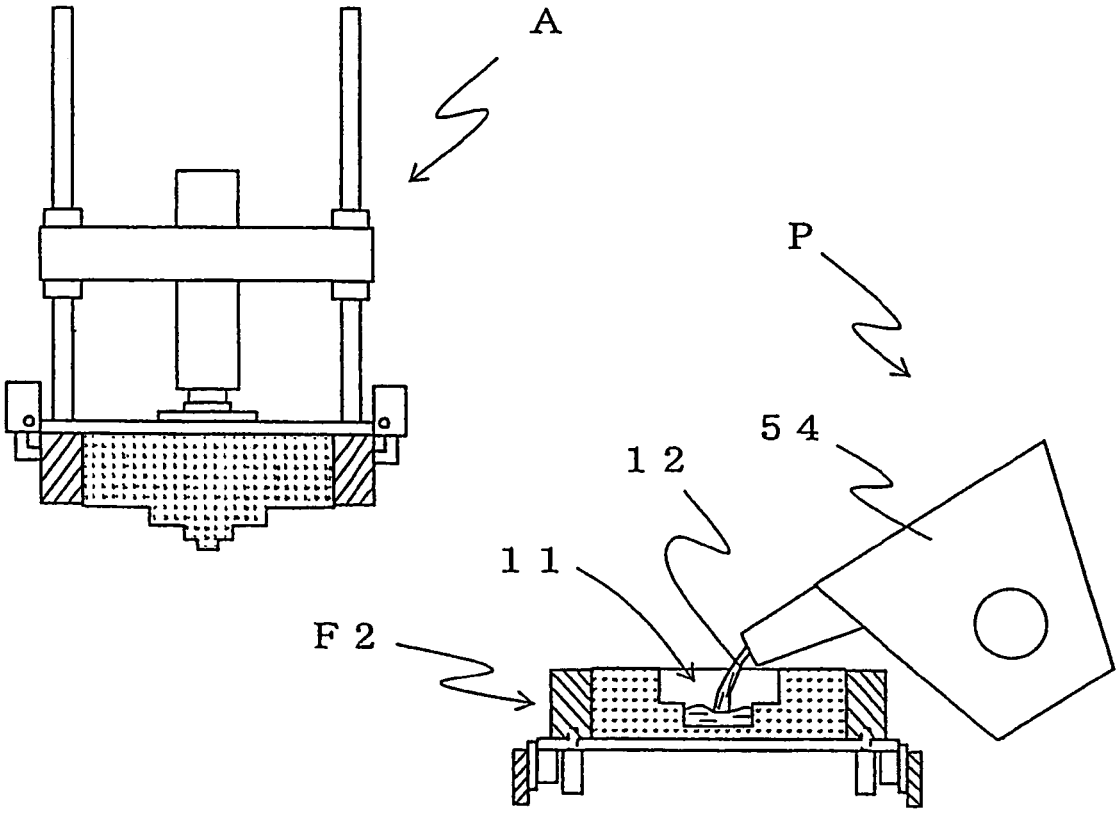
FIG. 6 shows a chart of the press for pouring the molten metal.

The casting method for producing a casting and the press used for the casting method of the present invention are explained below based on the Figures. As shown in FIGS. 1 and 6, the press A for the casting method according to one embodiment of the present invention is arranged along the molding line, opposite to a pouring device P of a tilting-type ladle. This press A comprises a movable frame 1 to be connected to a carriage (not shown) which runs back-and-forth in the crosswise directions (left-right directions in FIG. 1) S; an up and down means B attached to the movable frame 1; a plate 3 that presses a mold connected to the end portion 2*a* of a rod 2 of the up and down means B: guide rods 4 provided at the four corners of the plate that presses the mold, for example, four fixing means C which support the upper mold F1 on two opposite sides of the four sides of the plate 3 that presses the mold; a detection means D to detect the pressure which the upper mold F1 receives from the molten metal 12 poured into the lower mold after the pouring is completed, and the lower mold F2 (the pressure the upper mold F1 receives from the molten metal 12 and the parting plane of the upper mold and the lower mold) when the upper mold overlaps the lower mold; and a control means E. The guide rods 4, according to the embodiment of the present invention, are provided perpendicularly at the four corners of the plate 3 that presses the mold, but they are not limited to these positions. In the present invention they may be provided at diagonal positions on the plate that presses the mold.

In one embodiment of the present invention, the up and down means B uses an electric servo-cylinder that can control its position, and can also control the speed very accurately, but the embodiment is not limited to this means if the rod 2 can be lifted and lowered by, for example, electrical, hydraulic or pneumatic means. The electric servo-cylinder incorporates a screw structure, a drive-motor, a rotary encoder acting as a device to detect the position, and the like. In place of the electric servo-cylinder that can control the position and the speed, an electric servo-cylinder that can control the speed and a linear scale that can detect and control the position can also be used.

The fixing means C is not limited to a particular means, and it can be structured so as to consist of a driving mechanism such as an air cylinder, and a clamping part which rotates, extends, or contracts by means of the driving mechanism, so long as it can support the upper mold F1 on the plate 3 that presses the mold. A support structure that uses an electromagnet or one that uses a suction support can be adopted.

The detection means D is not limited to a specific means. It can suitably be selected depending on the kind of up and down means, so long as it has a function to detect the pressure that the upper mold F1 receives from the molten metal 12 and the lower mold F2. In the present embodiment, as the electric servo-cylinder is used, a load cell attached to the end portion 2*a* of the rod of the up and down means B is-selected as the means to detect the pressure.

Further, the control means E consists of an operation-circuit for the back and forth movement of a carriage, an operation-circuit for controlling the lifting and lowering of the up and down means B, such as the lifting speed, the lowering speed or stopping of it, an operation-circuit for a fixing means C and a control-circuit that interfaces, connects, and controls these operation-circuits, and a memory that stores information on the status of the upper mold, which information is input in advance.

In the present invention, a shape of a casting must be promptly pressure-transferred by overlapping the lower mold F2 with the upper mold F1 before the poured molten metal 12 solidifies. Therefore, the lowering speed as a movement of the rod 2 of the up and down means is arranged so as to be at the predetermined first speed until the predetermined position (the distance from the surface of the molten metal 12 to the convex portion 13 of the upper mold F1) is reached just before the upper mold F1 starts contacting the surface of the molten metal 12, which is poured into a concave portion 11 of the lower mold F2, and also arranged so as to be at the predetermined second speed after the upper mold is further lowered beyond the predetermined position.

Also, the control means E controls the movement of the up and down means B in such a way that it stops the lowering of the upper mold F1, based on a signal when the detection means D detects and obtains, as information on the status of the upper mold, the information that the pressure that the upper mold F1 receives from the molten metal 12 and from the lower mold F2 has reached a certain predetermined level.

The predetermined position of the upper mold F1 relates to a shape of the convex portion 13 of the upper mold F1, which shape corresponds to a shape of a casting, and it relates to the predetermined first speed, which is the lowering speed of the up and down means B. For example, if the surface of the convex portion 13 is smooth and the first speed is high, the surface of the molten metal may be distorted because the upper mold F1 will tend to cause a greater wind pressure. Therefore, in such case the predetermined position must be moved farther away so as to prevent the air from remaining in the molten metal and from being involved in the casting, when the upper mold and the lower mold overlap. That is, the distance between the upper mold F1 and the surface of the molten metal 12 must be greater. On the other hand, if the first speed is low, the predetermined position must be set closer, so that the molten metal cannot solidify. If it were to solidify the upper mold F1 could not reach the predetermined completion position. Therefore, the predetermined position and the first speed are suitably adjusted based on experiments which have used various shapes of castings, temperatures of the poured molten metals, and materials of the molten metals. In the present embodiment, the shape of the convex portion 13, as the shape of the casting, is of a pyramid, and the temperature of the poured molten metal is higher than that of the liquid-phase line by more than 100 to 200° C. Therefore, the first speed is set at the maximum speed listed in the catalogue for the electric servo cylinder, for example, at about 375 mm/sec, and the predetermined position is set at 1-100 mm.

In the present embodiment of the casting method, the upper mold must promptly overlap the lower mold and the shape of the mold must be pressure-transferred, before the molten metal poured into the lower mold solidifies. Therefore, if the predetermined second speed is high, the molten metal 12 is affected by an excessive pressure. It may cause a penetration of the surface of a casting. On the other hand, if the predetermined second speed is low, the molten metal 12 may solidify in the pressing process, so that the upper mold F1 cannot reach the predetermined completion position. Thus, the second speed is suitably adjusted based on experiments which have been made in various manufacturing conditions, varying, for example, the weight, the shape of castings, and the quantity and the temperature of the molten metal.

Figure 2:
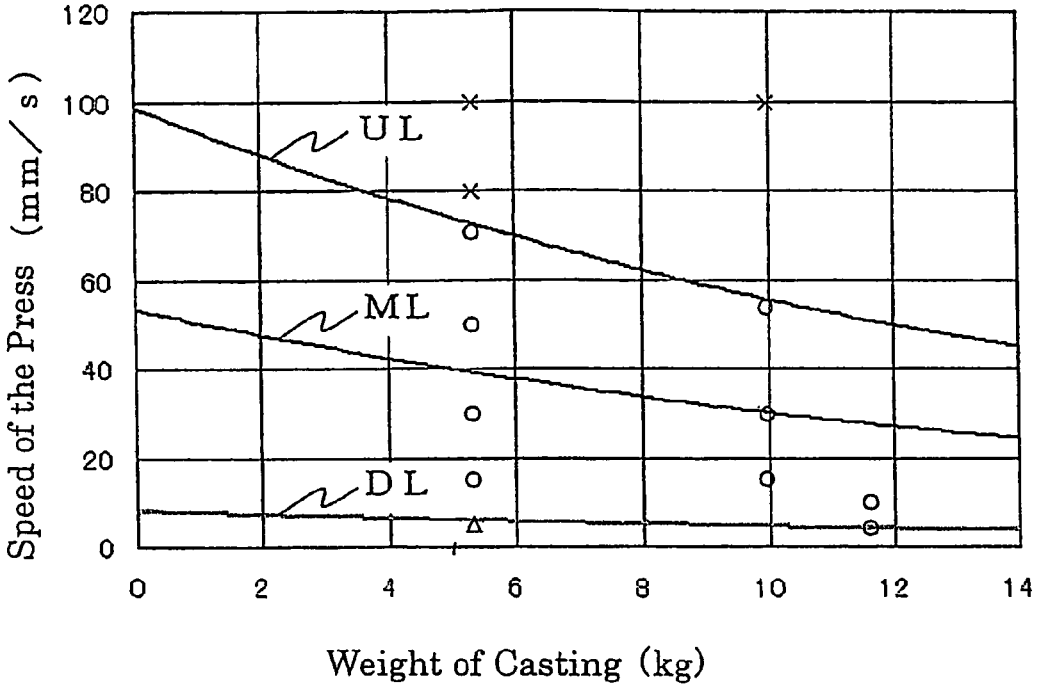
FIG. 2 shows the relationship between the weight of a casting and the second speed.

In the present embodiment, experiments were made for molten metal of temperatures of about 1360° C. and about 1400° C., so as to determine a suitable scope of a second speed (speed of pressing) in relation to the weight of a casting as shown in Table 1. FIG. 2 shows the results of the experiments.

TABLE 1

| casting (tested product) | weight (kg) |
|---|---|
| drum brake | 5.3 |
| disc brake | 9.9 |
| casting | 11.6 |

Figure 3:
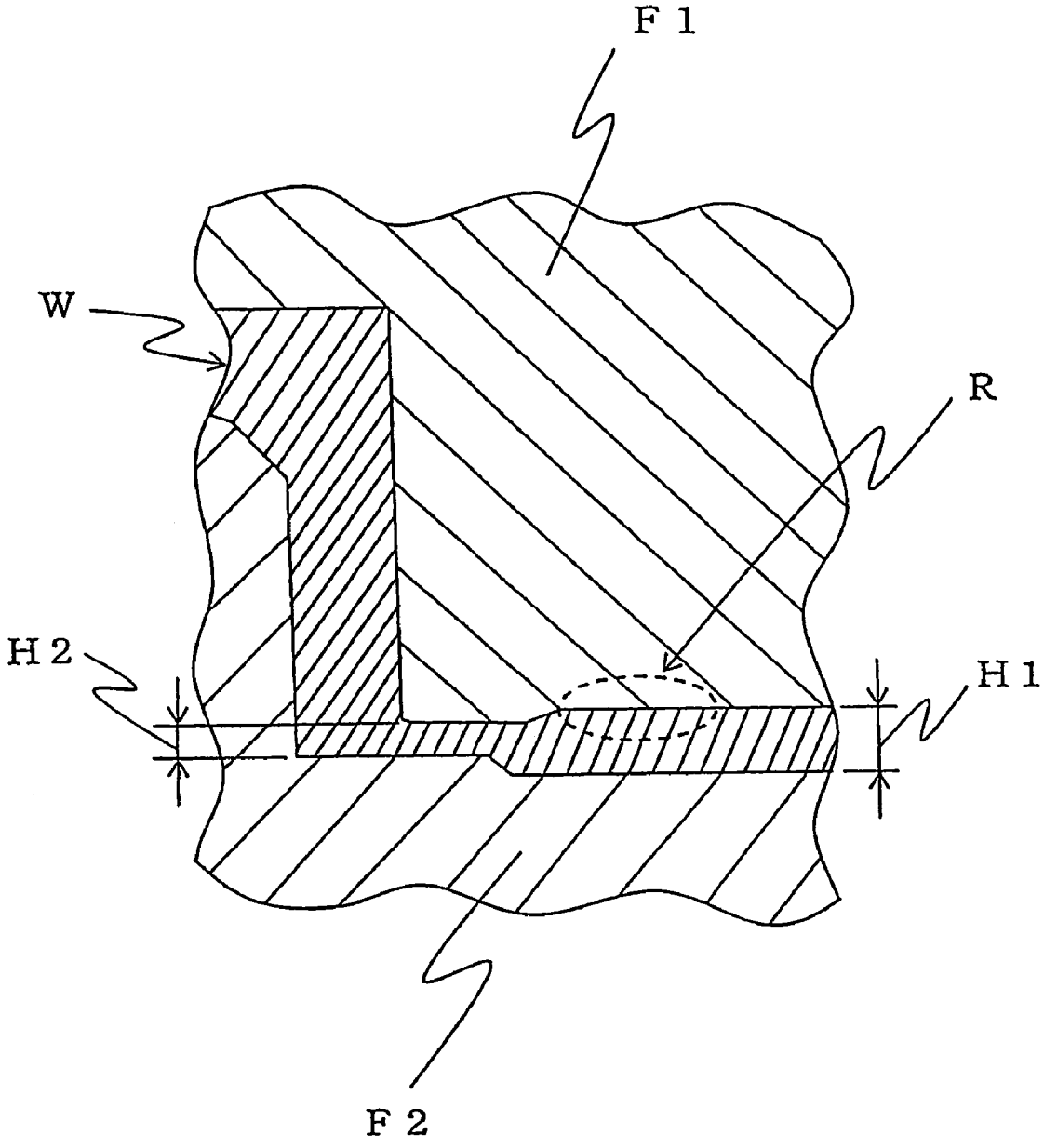
FIG. 3 shows a portion where a penetration has affected the casting.

The mark "○" in FIG. 2 shows the result of experiments where no penetrations for the molten metal at temperatures of about 1360° C. and about 1400° C. were found. The mark "Δ" shows the result of experiments indicating that there were not any penetrations for the molten metal at about 1400° C., but that there were a few penetrations for the molten metal at about 1360° C. The mark "×" shows the result of experiments where a penetration was found regardless of the temperatures of the molten metals. The areas where the penetrations were found are shown by "R" in FIG. 3. These areas correspond to those areas that comprise two different thicknesses, H1 and H2, in a casting W, as formed between the upper mold F1 and the lower mold F2. Apparently this was because the pressure of the molten metal became excessively high when it flowed from a portion of a casting that had a greater thickness into a portion that had a smaller thickness. FIG. 2 shows that the relationship between a weight of a casting and the second speed can be expressed by a quadratic curve that shows that the weight of the casting decreases as the second speed increases. Thus a line UL, showing the upper speed limit for the second speed, and a line DL, showing its lower speed limit, are defined within ±85-88% of the mid-point line ML, depending on the temperature of the molten metal. If, for example, the temperature of the molten metal is at about 1400° C., which is a normal temperature of use, and if the scope of the tolerance is taken to be at ±85%, then the upper speed limit is worked out as $40\times(1+0.85)=74$ mm/s and the lower limit as $40\times(1-85)=6$ mm/s. This is because when the weight of the casting is 5 kg, the mid-point of the speed is 40 mm/s.

Therefore, a control means E preferably comprises a memory circuit that stores a preset formula expressing the relationship of the weight of a casting and the second speed, and an input circuit that sets the second speed to a speed that suitably corresponds to the weight of the casting. Thus based on that formula a casting of good quality can be produced by setting the second speed to suitably correspond to the weight of the casting. Even when a change of a casting is made it also is possible to reduce the time to change and to input the conditions for setting the second speed in the memory-circuit, once a second speed that suitably corresponds to the weight of the casting has been obtained.

Moreover, the pressure can be predetermined by experiments, based on the surface area of the parting plane of the upper mold, the shapes of the upper and lower molds, and the speed of the press. Thus, after the upper mold F1 and the lower mold F2 start contacting each other, the upper mold F1 can be stopped at a position where the upper mold F1 does not excessively penetrate.

Figure 4:
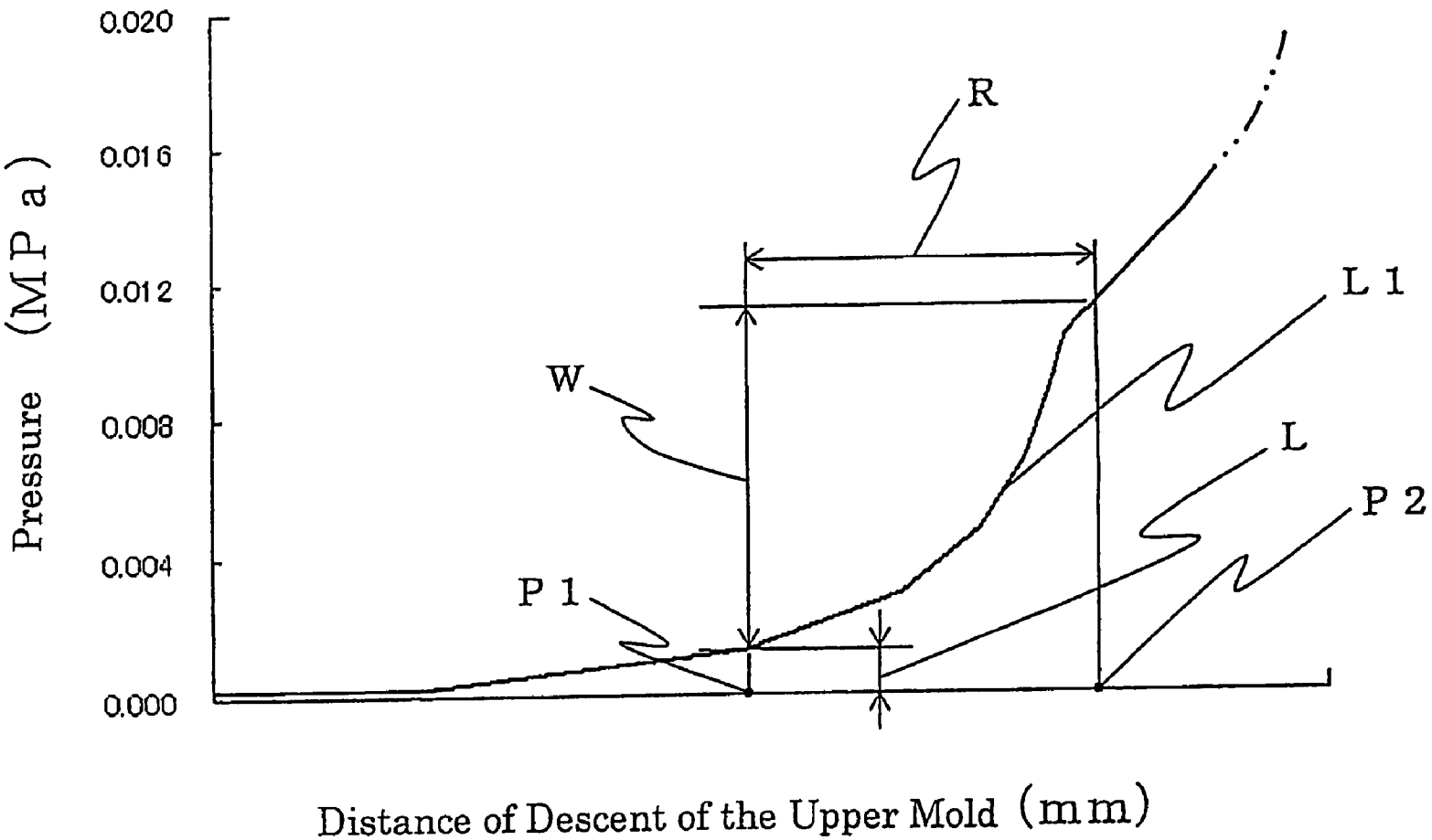
FIG. 4 shows a curve of the pressure.

In the present embodiment, the experiments are made by changing the temperature of the molten metal (the temperature of the molten metal being poured). As shown in FIG. 4, first, in a curve of the pressure L1 when the temperature of the poured molten metal is at about 1406° C., the pressure increases gradually from the point P1, where the upper mold starts contacting the lower mold after the upper mold is lowered at the second speed. Then it starts increasing linearly from the point P2, to where the upper mold has been lowered by a predetermined distance. In the curve of the pressure L1 of this experiment, from the point P1, where the upper mold starts contacting the lower mold, up to the boundary point P2, where the upper mold F1 does not excessively penetrate, the pressure W was at 0.010 MPa. In this experiment, the surface area of the parting plane of the upper mold was 88,842 $mm^2$, and the second speed as a lowering movement of the up and down means B was 30 mm/sec.

Figure 5:
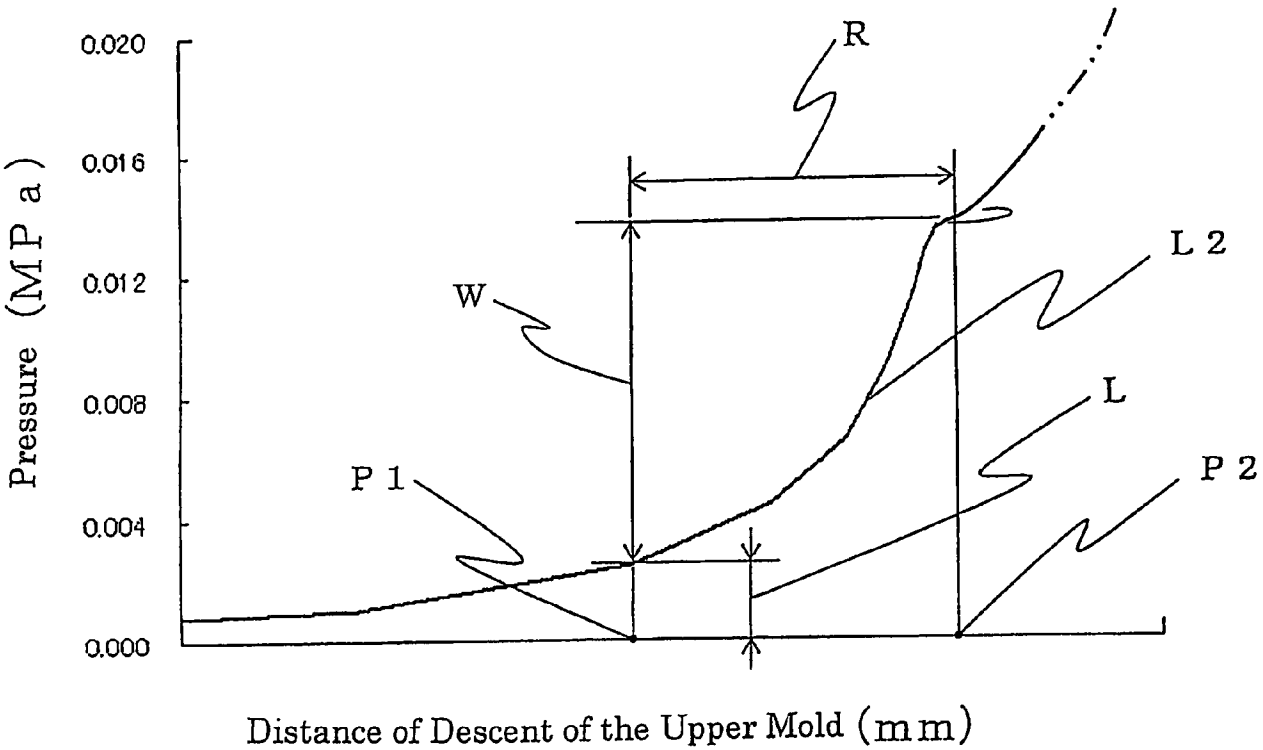
FIG. 5 shows a curve of the pressure when the temperature of the molten metal is varied.

Next, an experiment was made in the same way, except that the temperature of the poured molten metal was about 1363° C. In a curve of the pressure L2 of this experiment, as shown in FIG. 5, the pressure increases gradually from the point P1, where the upper mold starts contacting the lower mold, after the upper mold is lowered at the second speed as in the experiment with the curve of the pressure L1 as seen above. The pressure starts increasing nearly linearly from the point P2 to where the upper mold has been lowered by a predetermined distance. In a curve of the pressure L2 of this experiment, from the point P1, when the upper mold starts contacting the lower mold up to the boundary point P2, where the upper mold F1 does not excessively penetrate, the pressure was at 0.011 MPa. Therefore, the curves of the pressures are similar even when the temperature of the poured molten metal is changed. That is, as in FIGS. 4 and 5, the area of the pressure L has different shapes in the start-up period up to the point P1, where the upper mold starts contacting the lower mold. This is because the convex portion of the upper mold is affected by the viscosity of the molten metal when it enters the molten metal in the lower mold. However, the curves of the pressures L1 and L2 show almost the same pressing characteristics from the point P1 up to the boundary point P2 where the upper mold F1 does not excessively penetrate.

Thus in the present invention, the upper mold stops being lowered at a certain point. This is based on the information that the pressure has reached a predetermined level. This information comes from the information obtained, within the area "R", on the pressures that the upper mold receives from the molten metal and from the lower mold, from the point P1, where the upper mold, which overlaps the lower molds, starts contacting the lower mold up to the boundary point P2 where the upper mold F1 does not excessively penetrate.

In the present invention, even when the temperature of the molten metal is changed, the curves of the pressures maintain the same pressing characteristics. Therefore, the upper mold can be stopped from being lowered at a certain time and distance. This is based on information that the distance of the descent of the upper mold reaches a predetermined distance. This information comes from among the information, within the area "R", on the distance that the upper mold is lowered from the point P1, where the upper mold, which overlaps the lower molds, starts contacting the lower mold up to the boundary point P2, where the upper mold F1 does not excessively penetrate. A device for detecting this position, such as a rotary encoder or a linear scale, is also used as a detecting means.

The press of this embodiment is explained below. First, the mold consists of a lower mold F2 and an upper mold F1. The lower mold F2 is a mold molded in a molding flask 22, by a green sand molding method, using green sand 31. The lower mold F2 has a concave portion 11 having the shape of a casting. Into this portion the quantity of molten metal 12 that is required to produce a casting is poured. The upper mold F1 is a mold molded in a molding flask 32, by the green sand molding method, using green sand 31. The upper mold F1 has a convex portion 13, having the shape of a casting, which convex portion forms a cavity that is required to produce a casting.

Then, as shown in FIG. 1, after the upper mold F1 in the inverted position is transferred by a conveyor line 51, by, for example, a roller conveyor, after the molding is completed, by lowering the mold pressing plate 3, the upper mold F1 is fixed to the mold pressing plate 3 of the press by the fixing means C. Then the upper mold is moved backward from the molding line and is kept at a stand-by position. The lower mold F2 is then transferred and is fixed on the stool 52 at a position where the molten metal is poured. The fixing is made, for example, by inserting rods of a positioning cylinder 53, through openings formed at the four corners of the lower mold F2 and the stool 52 where the lower mold F2 is loaded.

Figure 7:
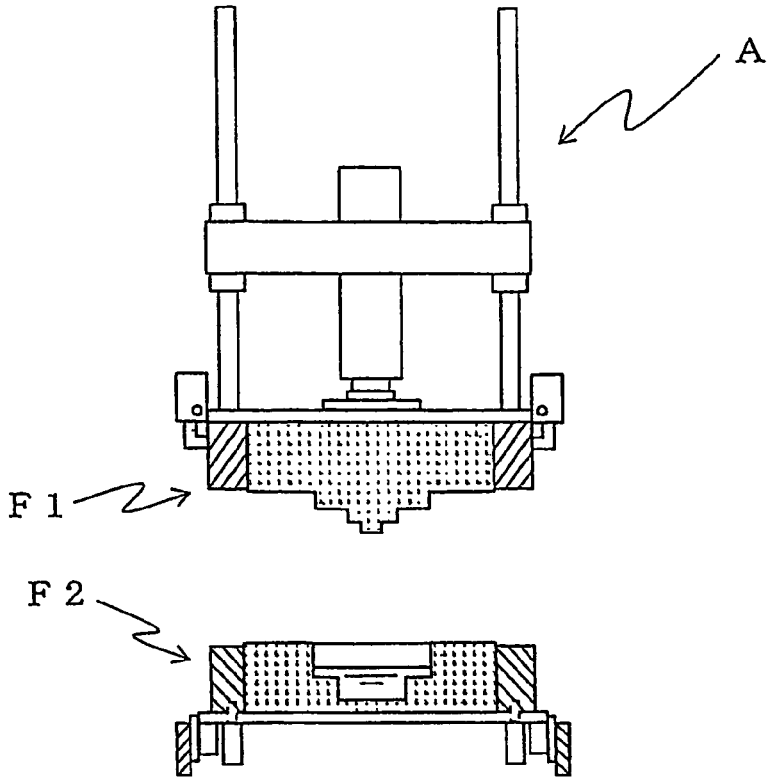
FIG. 7 shows a view where the upper mold is transferred to the position where it is positioned above the lower mold after the pouring of the molten metal is completed.

Then, as shown in FIG. 6, a pouring machine P, which is at a stand-by position off the molding line, is transferred close to the lower mold F2. By tilting a ladle 54, the molten metal is then poured into a convex portion 11 of the lower mold in the amount of 120% or less of the volume of the cavity. After the pouring is completed, the pouring machine is retracted from the molding line, and, as shown in FIG. 7, the press A is transferred to the position where the upper mold F1 is positioned above the lower mold F2.

Figure 8:
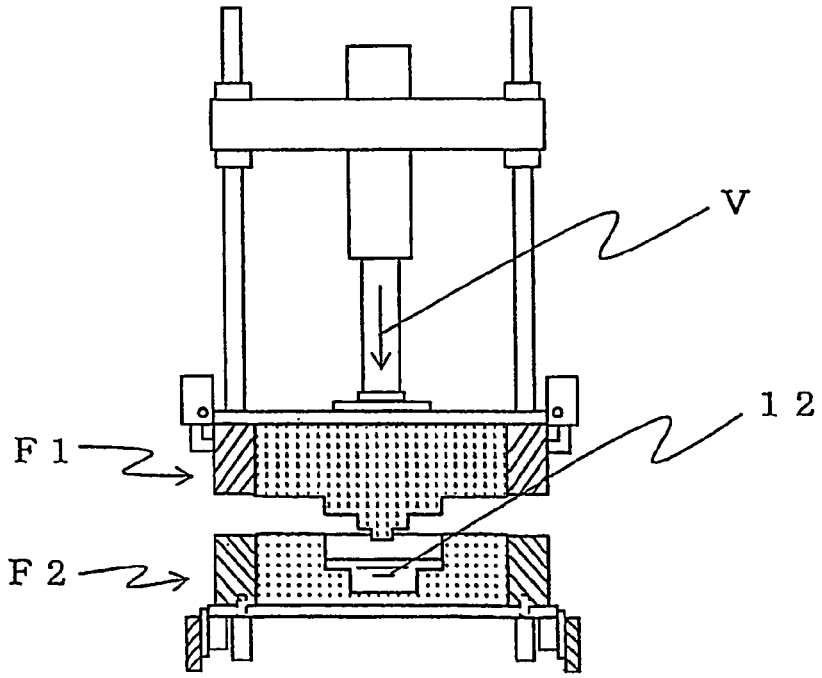
FIG. 8 shows a view where the upper mold is lowered at the first speed.

Then, as shown in FIG. 8, the upper mold is lowered, at the first speed of 375 mm/s (shown by an arrow V), to a position 15 mm farther away from the position where it starts contacting the molten metal 12, which is filled in the lower mold.

Figure 9:
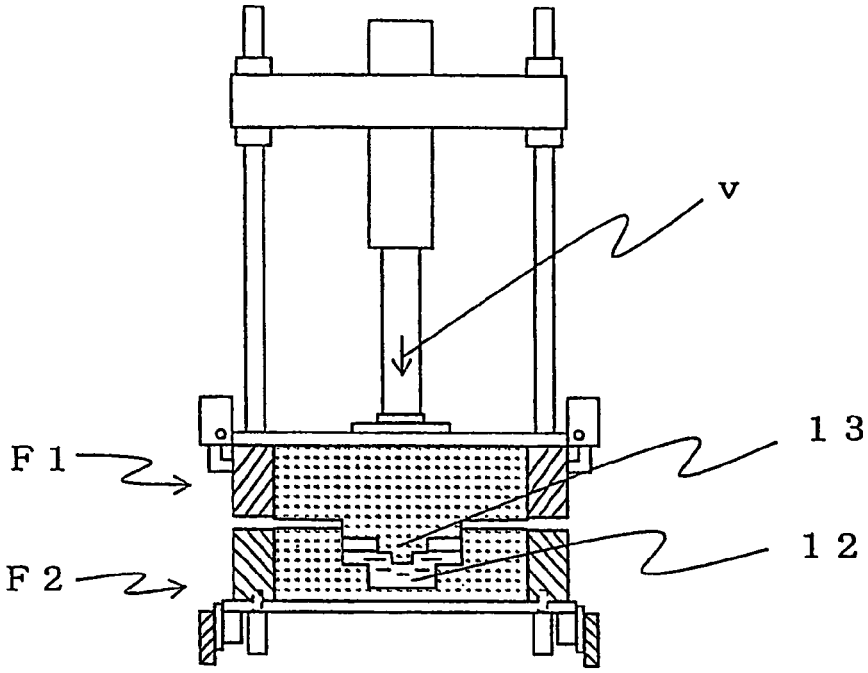
FIG. 9 shows a view where the upper mold is lowered at the second speed.
Figure 10:
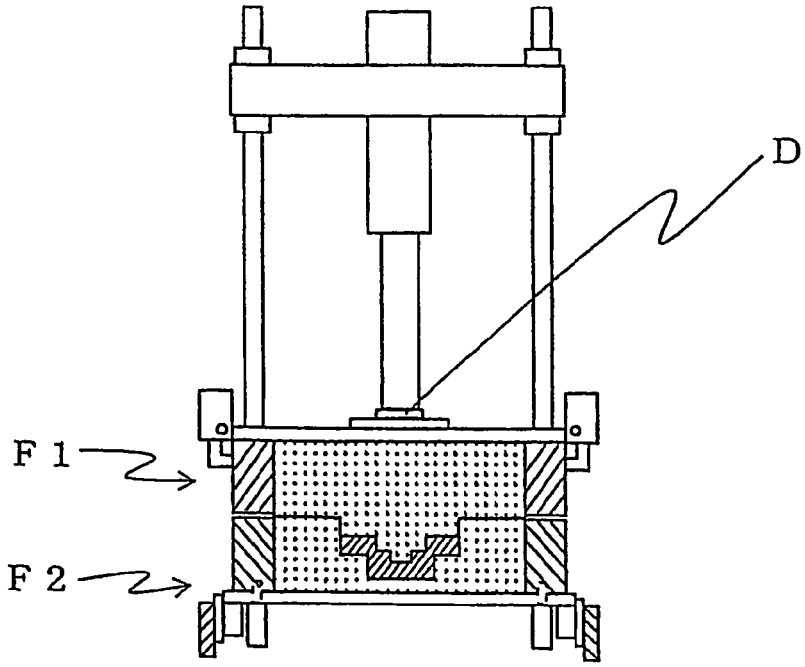
FIG. 10 shows a view where the upper mold stops lowering after it overlaps the lower mold and pressing is completed.

Next, as shown in FIGS. 9 and 10, after the position right before where the upper mold starts contacting the molten metal, the lowering speed of the upper mold F1 is changed to the second speed of 15 mm/s (shown by an arrow V). The upper mold is further lowered, keeping any distortion of the molten metal to a minimum, and the convex portion 13 of the upper mold F1 enters the molten metal 12. The upper mold F1 overlaps the lower mold, and it starts contacting the lower mold F2. Then the upper mold F1 stops being lowered at a position where it does not excessively penetrate, and when the pressure as measured by a load cell used as a detection means reaches 0.004 MPa. After duration of a certain time, the clamp is removed and the pressing work is completed.

In the present embodiment, it was seen above that as the curve of the pressures maintain the same pressing characteristics, even when the temperature of the poured metal varies, it is possible to set a descending stroke of the upper mold (a position of completion of pressurizing) based on the information on the status of the upper mold, which overlaps the lower mold. That is, the descending stroke of the upper mold is determined under the conditions that the lower mold is filled with molten metal. However, the distance of descent under such conditions is measured when the upper mold is affected by an impact that it receives from the molten metal. Therefore, it is feared that such a descending stroke does not reflect the precise descending stroke that actually occurs. Also, a sand mold is affected by the pressure of the molding, the characteristics of the sand, the shape of the pattern, and its measurements, especially its height (hereafter called molding conditions). Thus the sand mold often presents different measurements.

Figure 11:
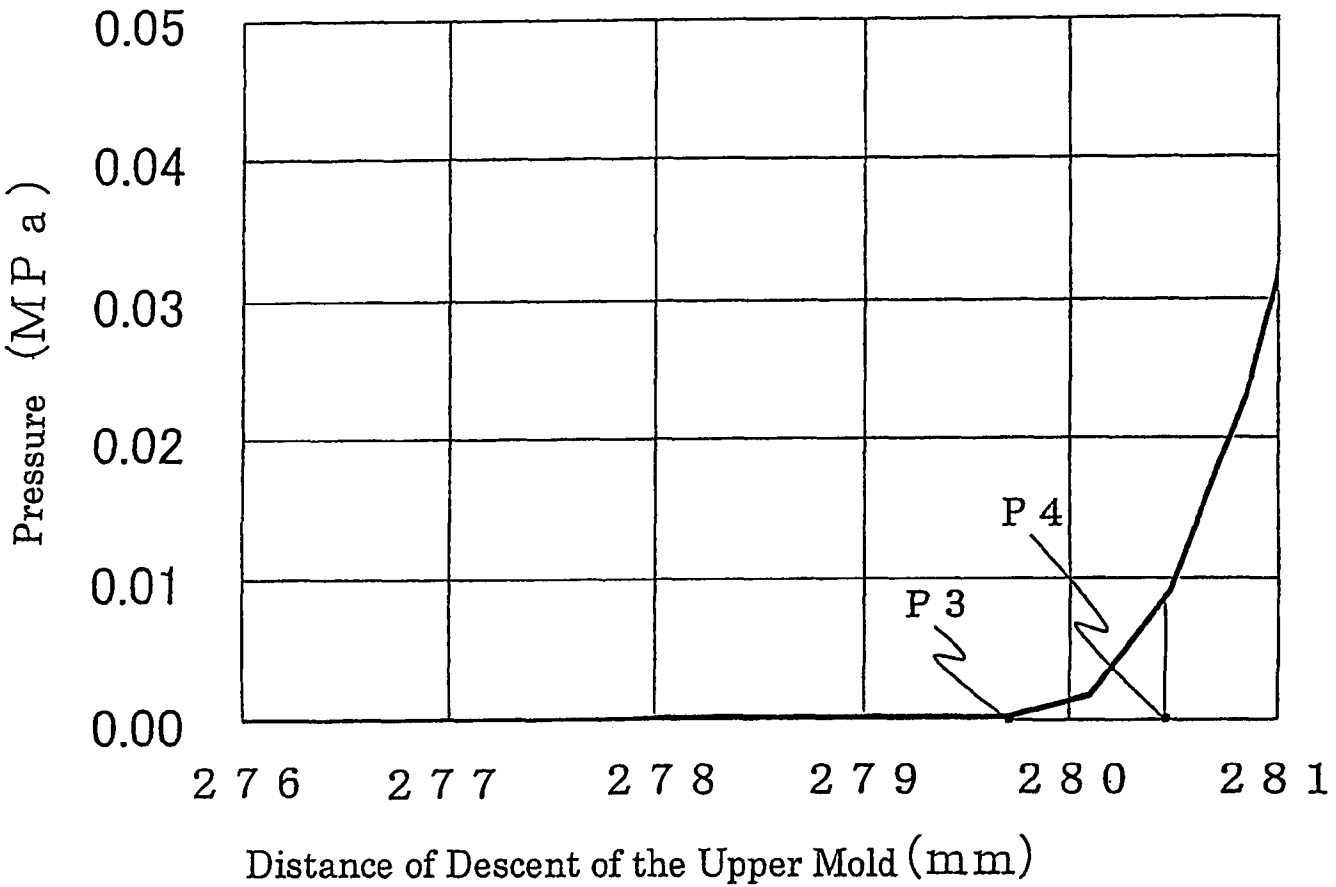
FIG. 11 shows a curve of the pressure when there is no molten metal in the lower mold.

Thus, in another embodiment of the present invention, to determine a more precise descending stroke, a descending stroke is determined, as shown in FIG. 11, by measuring the pressure on the upper mold when it overlaps the lower mold, when the upper mold is considered to complete a pressing and when it is not any longer being lowered and under the conditions that the lower mold does not contain any molten metal. In FIG. 11, when the upper mold and the lower mold start contacting each other, if the pressure at the overlapping plane (parting plane) formed by the upper mold and the lower mold is about 0.01 MPa, the upper mold and the lower mold are considered to be firmly attached at point P4. Then the descending stroke of the upper mold (the position of completion of pressing) is determined to be at about 280.4 mm.

When the above molding conditions are changed or when the measurements are made, at predetermined intervals, with the descending stroke of the upper mold as the position of completion of the pressing, then so as to have the molding conditions that are changed be reflected or to set a descending stroke calculated from the measurement as made at predetermined intervals, as the descending stroke of the upper mold to produce a casting, the molding method to produce a casting, of the present embodiment, comprises a process of lowering the upper mold toward the lower mold; a process of detecting a relationship between the descending stroke of the upper mold and the pressure that the upper mold receives from the lower mold when the upper mold overlaps the lower mold; and a process of setting, based on that relationship, a descending stroke of the upper mold under that pressure. In this way a suitable position for the completion of pressing can be decided, such that a produced casting will have highly accurate dimensions.

Figure 12:
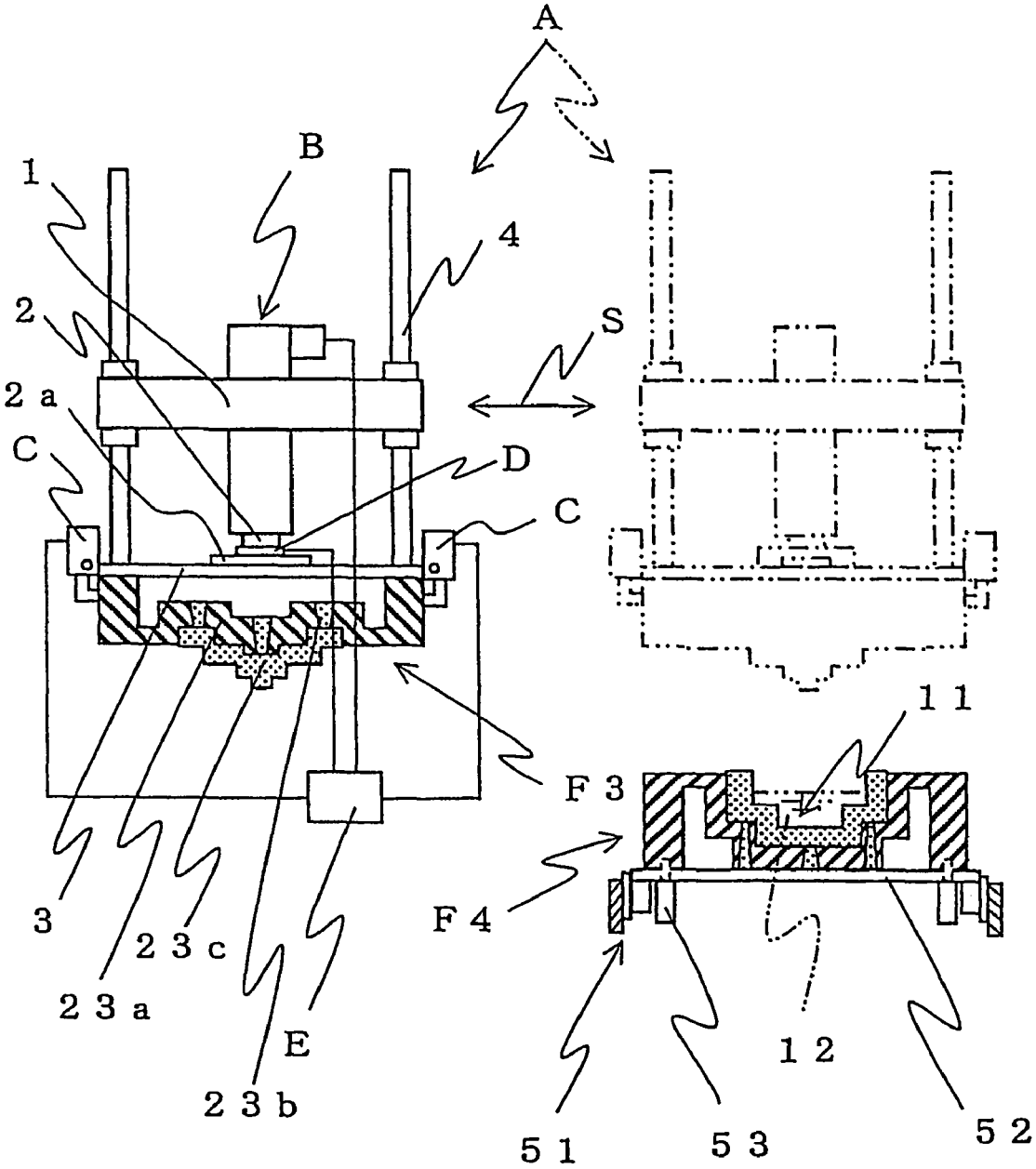
FIG. 12 shows a schematic view in one embodiment of the press for casting by the back metal method.

In the above embodiment, a mold with a molding flask is used. But a mold in a back metal process, which is intended, for example, to minimize a use of the foundry sand, and where the foundry sand is blown from a blow-in opening 23*b* onto the surface of a permanent mold 23*a* such as the upper mold F3 and the lower mold F4, as shown in FIG. 12, and which has formed a shape of a sand layer 23*c*, can also produce a casting that has as highly precise dimensions as those produced by a mold that uses a molding flask. The operational structure of the press A and its control are basically the same as those of the press used when the mold with a molding flask is used. Further, in a back metal method the backup is not limited to a permanent mold. A back metal formed by metal balls, cement, mortar, or the like, can also be used. The sand layer that forms a portion of a shape of a casting can be suitably molded by various known molding methods, such as a green sand mold, shell mold, cold box molding process, self-hardening mold, and the like.

Further, this molding method can use a flaskless mold, where a sand mold is stripped from the molding flask after the molding or the matching of the molds is completed.

Figure 13:
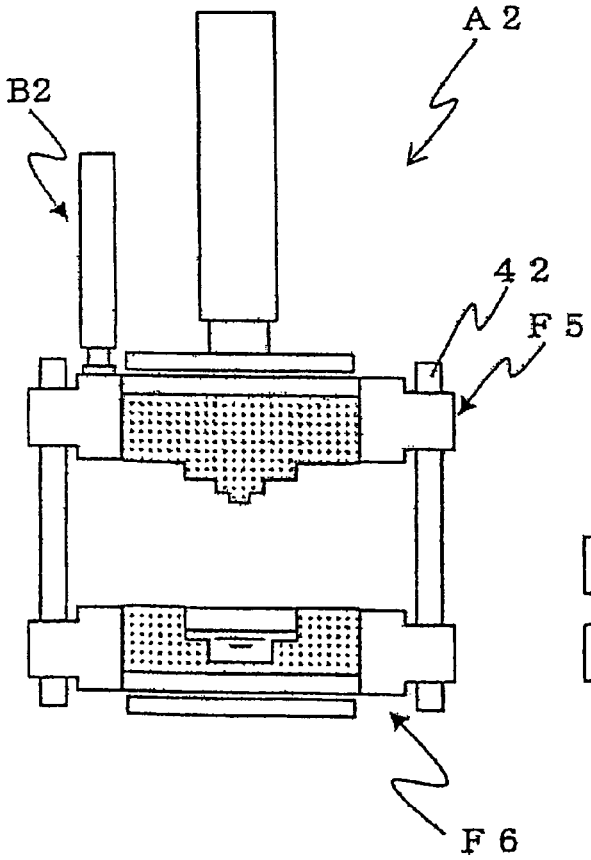
FIG. 13 shows a schematic view in one embodiment of the press for casting, illustrating the first process for stripping a sand mold from a molding flask after matching the molds.
Figure 14:
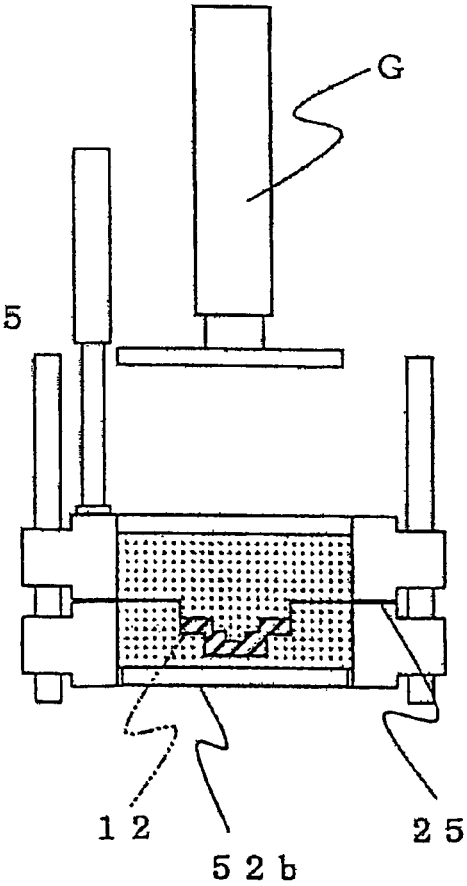
FIG. 14 shows a schematic view in one embodiment of the press for casting, illustrating the second process for stripping a sand mold from a molding flask after matching the molds.
Figure 15:
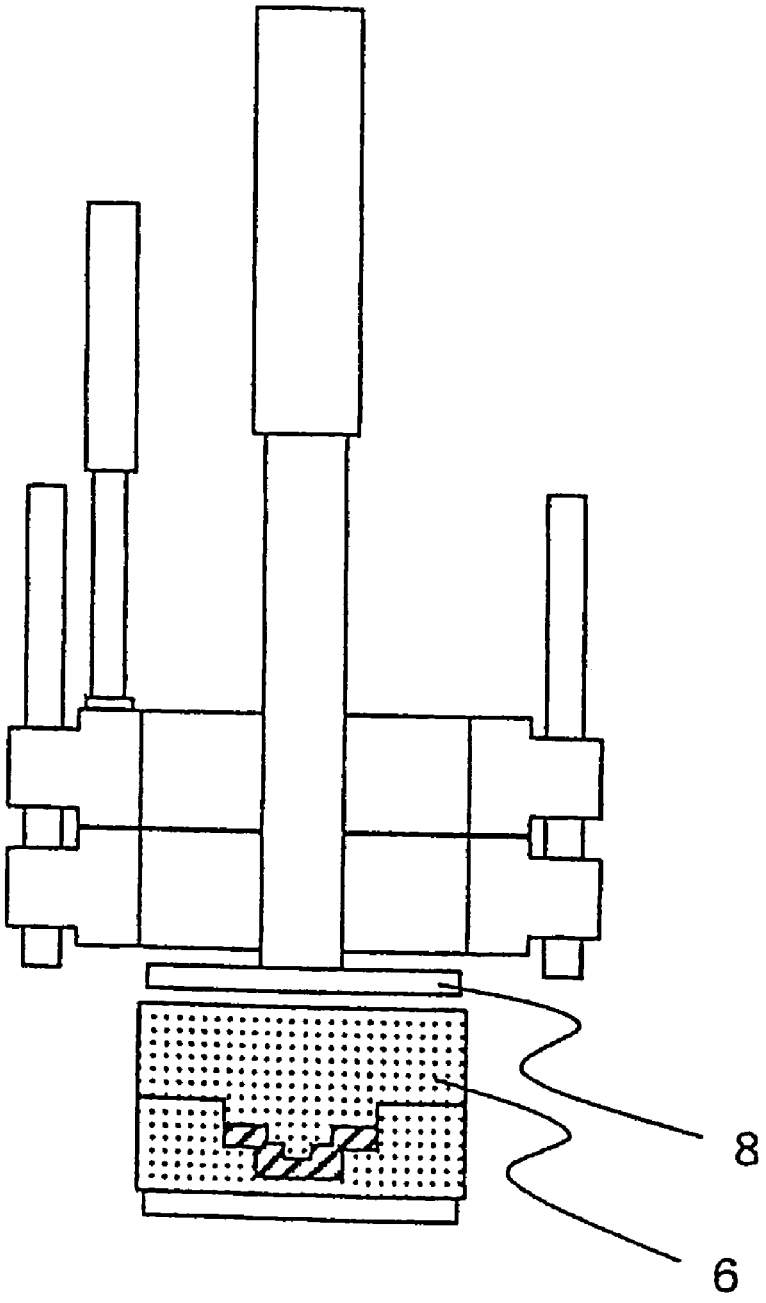
FIG. 15 shows a schematic view in one embodiment of the press for casting, illustrating the third process for stripping a sand mold from a molding flask after matching the molds.

FIGS. 13-15 show schematic views of the press when a sand mold is stripped from the molding flask after the matching of the molds is completed. The press A2 comprises: guide-rods 42 that support the upper mold F5 and the lower mold F6 after molding is completed; a up and down means B2 to lift and lower the upper mold F5; a mold stripping means G to strip a sand mold 6 from a molding flask 25 after the upper mold F5 overlaps the lower mold F6; and a stool 52*b* on which the sand mold 6 is placed.

In the pressing process the molten metal 12 is cast after it is poured in the lower mold F6, and the upper mold F5 and the lower mold F6 are overlapped by the hoist means B2 (FIG. 14). Then a stripping plate 8 which is placed at the end portion of a mold stripping means G, is lowered and the sand mold 6 is placed on the stool 52*b* (see FIG. 15).

Figure 16:
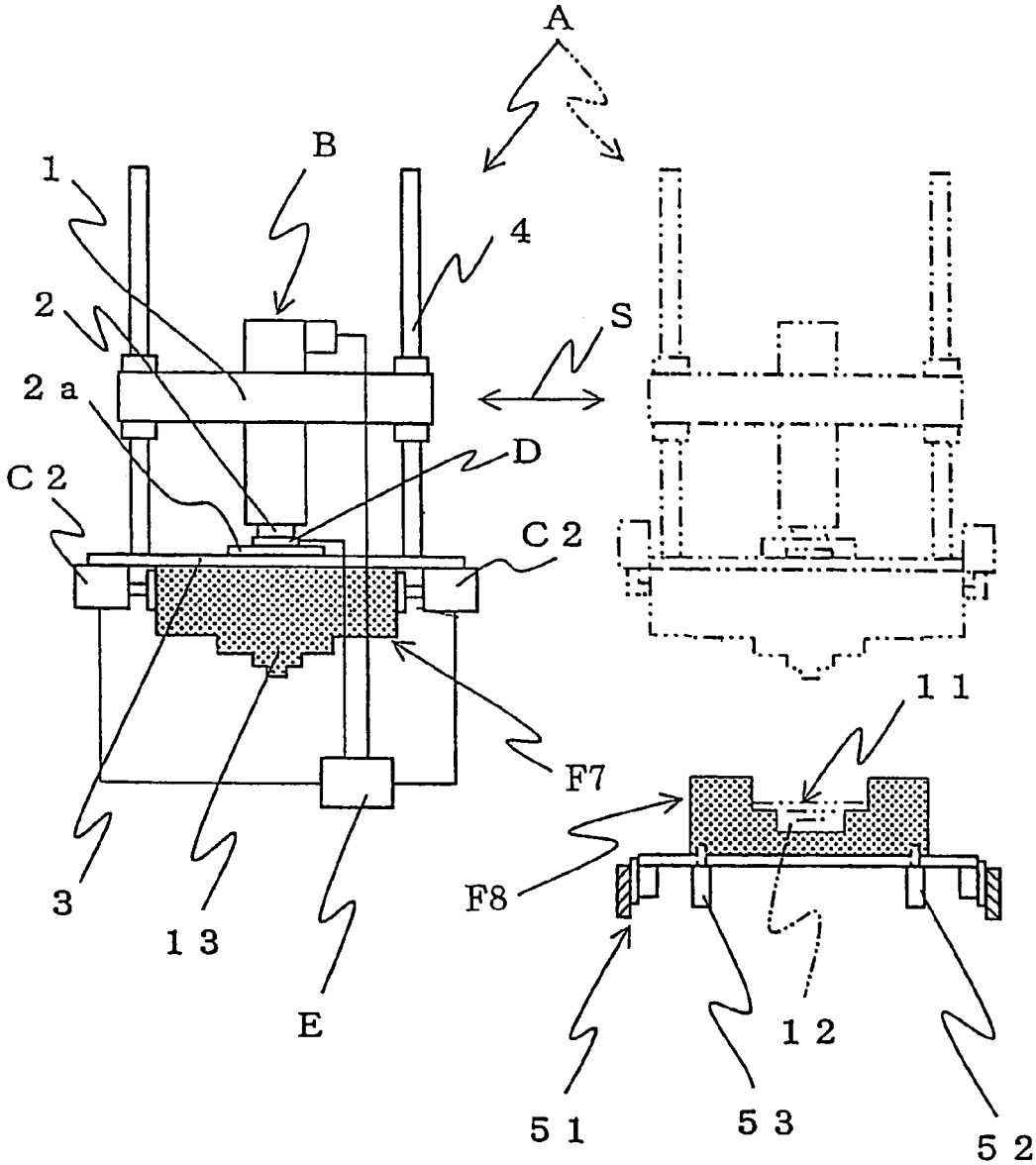
FIG. 16 shows a schematic view in one embodiment of the press for casting when a sand mold has been stripped from the molding flask after the molding was completed.

FIG. 16 shows a schematic view of the press when the sand mold is stripped from the molding flask after molding is completed. When the upper sand mold F7 and the lower sand mold F8 are placed in the press A, the pressing of the mold can be performed under the same conditions as in a case of a mold using the molding flask. The fixing means C2 that holds the upper sand mold F7 and the mold-pressing plate 3 is not limited to any specific structure so long as it can fix the upper mold F7 to the mold-pressing plate 3. It can be constituted, for example, such that the fixing means clamps the upper sand mold F7 and fix it to the pressing plate 3 by means of air cylinders, or the like, that are positioned at opposite sides of the upper sand mold F7. The flaskless mold is suitably molded by various known molding methods such as a green sand mold, shell mold, cold box molding process, self-hardening mold, and the like.

The invention claimed is:

1. A press for producing a casting from molten metal in a mold, said press comprising:

a movable frame;

an up-and-down means having a rod attached to the movable frame;

a plate connected to an end portion of the rod of the up-and-down means;

guide rods that extend perpendicularly upward from the plate and slide with respect to the moveable frame to guide the plate when the plate is moved up and down by the up-and-down means;

an upper molding flask containing an upper sand mold having a convex portion;

a fixing means attached to the plate to fix the upper molding flask thereto so that the convex portion of the upper sand mold faces downward;

a fixed lower molding flask containing a lower sand mold having a concave portion facing upward and corresponding to the convex portion of the upper sand mold so that a cavity in the shape of a casting is formed when the upper sand mold is overlapped and pressed onto the lower sand mold to form a mold;

a detection means attached to the end portion of the rod of the up-and-down means for detecting and obtaining information on the status of the upper sand mold, which upper sand mold is caused to overlap and be pressed against the lower sand mold by downward movement of the plate by the up-and-down means after molten metal has been poured into the convex portion of the lower sand mold;

operation circuits for controlling movement of the movable frame, lifting and lowering movement of the up-and-down means, the fixing means, and the movement of the up-and-down means based on the information detected and obtained by the detection means, wherein the operation circuit for the up-and-down means has an input circuit that sets a speed of the up-and-down means at a predetermined first downward speed until the upper sand mold is lowered to a predetermined position just before the upper sand mold starts contacting a surface of molten metal in the lower sand mold, and then sets a speed of the up-and-down means at a predetermined second speed after the upper sand mold is further lowered beyond the predetermined position to overlap and press the upper sand mold against the lower sand mold and form the mold in which a casting is produced in said cavity; and a memory circuit that stores the information on the status of the upper mold, which is information on the pressure that the upper sand mold receives from the molten metal and the lower sand mold or a distance that the upper sand mold descends.

2. The press according to claim 1, wherein the memory circuit stores a preset formula expressing a relationship of a weight of the casting and the second speed, and the input circuit sets the second speed to a speed that suitably corresponds to the weight of the casting.

3. The press according to claim 2, wherein the formula is a quadratic curve that shows that the weight of the casting decreases as the second speed increases.

4. The press according to claim 2 or 3, wherein the second speed is within ±85-88% of the mid-point of the second speed as defined by the formula expressing the relationship of the weight of the casting and the second speed.

* * * * *